US005799592A

United States Patent [19]

Kmiotek et al.

[11] Patent Number: 5,799,592

[45] Date of Patent: Sep. 1, 1998

[54] INLET GUIDE VANES FOR PULVERIZER EXHAUSTERS

[75] Inventors: Stanley E. Kmiotek, Tolland; Gregory R. Strich, Enfield, both of Conn.

[73] Assignee: Combustion Engineering, Inc., Windsor, Conn.

[21] Appl. No.: 774,153

[22] Filed: Dec. 26, 1996

[51] Int. Cl.[6] ..... F23K 1/00

[52] U.S. Cl. ..... 110/232; 110/106; 415/208.1

[58] Field of Search ..... 110/106, 104 R, 110/232, 102; 415/182.1, 188, 208.1

[56] References Cited

U.S. PATENT DOCUMENTS 442,614 12/1890 Dock ..... 415/183 X 3,266,437 8/1966 Blackmore et al. ..... 415/183 X 3,883,264 5/1975 Rao ..... 415/208.1 X 5,295,811 3/1994 Chiu ..... 415/182.1 X

*Primary Examiner*—Henry A. Bennett

*Assistant Examiner*—Susanne C. Tinker

*Attorney, Agent, or Firm*—Alix, Yale & Ristas, LLP

[57] ABSTRACT

An exhauster assembly for a solid fuel pulverizer has an exhauster housing defining an inlet opening. A fan rotatably mounts in the exhauster housing and a duct defining an air stream flow path is in fluid connection with the inlet opening. An inlet guide vane assembly is positioned in the duct adjacent the inlet opening. The inlet guide vane assembly has a plurality of first and second guide vanes defining a plurality of the flow channels generally parallel the air stream flow path. The first and second guide vanes are generally planar and arranged generally orthogonally to each other in cross section.

11 Claims, 3 Drawing Sheets

INLET GUIDE VANES FOR PULVERIZER EXHAUSTERS

FIELD OF THE INVENTION

This invention relates to solid fuel pulverizing for a solid fuel furnace. More particularly, this invention relates to the improved transport of a pulverized solid fuel in an air stream.

BACKGROUND OF THE INVENTION

Pulverizers are well-known for the reduction of the particle size of solid fuel to allow for combustion of the solid fuel in a furnace. A pulverizer employs some combination of impact, attrition and crushing to reduce a solid fuel to a particular particle size. Several types of pulverizer mills can be employed for the pulverization of the solid fuel, for example coal, to a particulate size appropriate for firing in a furnace. These can include ball-tube mills, impact mills, attrition mills, ball race mills, and ring roll or bowl mills. Most typically, however, bowl mills are employed for the pulverization of the solid fuel to allow for direct firing of the pulverized fuel entrained in an air stream.

Bowl mills have a grinding ring carried by a rotating bowl. Fixed position rollers are mounted on roller journal assemblies such that the roll face of the rollers are approximately parallel to the inside surface of the grinding ring and define a very small gap therebetween. Pressure for grinding is applied through springs or hydraulic cylinders on the roller journal to crush solid fuel caught between the roll face of the roller and the grinding ring.

An air stream is typically utilized for drying, classification and transport of the solid fuel through the pulverizer. The air stream employed is typically a portion of the combustion air referred to as the primary air. The primary air is combustion air first directed through a preheater whereby the combustion air is heated with energy recovered from the flue gas of the furnace. A portion of the primary air is then ducted to the pulverizers. In a bowl mill, the primary air is drawn through beneath the bowl of the bowl mill and up past the roller journal assemblies to collect the pulverized solid fuel. The small particles of solid fuel become entrained in the primary air. The air stream containing the solid fuel then passes through a classifier into the outlet of the pulverizer. After passing through the exhauster, the pulverized fuel can be stored, or more typically, is transported to the furnace by the air stream for direct firing.

A fan assembly referred to as an exhauster, is used to pump the air stream through the pulverizer. The exhauster is conventionally positioned on the outfeed side of the pulverizer for drawing the primary air through the pulverizer. This arrangement of pulverizer and exhauster is referred to as a suction system.

SUMMARY OF THE INVENTION

Briefly stated, the invention is an inlet guide vane assembly for a pulverizer exhauster. More particularly, the inlet guide vane assembly in accordance with the invention has an arrangement of inlet guide vanes positioned at the inlet opening of an exhauster for improved exhauster efficiency.

The capacity of a pulverizer is a function of the solid fuel properties, pulverizer size and air flow through the pulverizer. In a suction system, where the exhauster induces air flow through the pulverizer, improvement of the performance of the exhauster will result in improvement in the performance of the pulverizer. Analysis has shown that the air stream of primary air and pulverized fuel entering the exhauster tends to swirl in the direction of the rotation of the fan of the exhauster. This swirl of the air stream entering the exhauster decreases the efficiency and therefore the rate of flow of the air stream through the exhauster. The inlet guide vane assembly in accordance with the invention reduces the swirl of the inlet air stream in the direction of the exhauster rotation thereby improving exhauster efficiency. In one embodiment of the invention, the inlet guide vane assembly imparts a swirl to the air stream that is counter to rotation of the exhauster fan.

In a suction system wherein an exhauster is positioned on the outfeed side of a bowl mill, the air stream outlet of the bowl mill is typically at an elevated position relative to the inlet of the exhauster. A duct directs the air stream of primary air and pulverized fuel from the outlet of the bowl mill downward and generally through an elbow in the duct of greater than 90° angle into the inlet of the exhauster. The inlet guide vane assembly is preferably positioned in this elbow and extends to the inlet of the exhauster. However, the inlet guide vane assembly provides improved exhauster efficiency wherein the exhauster and pulverizer are in other orientations and the duct defines alternate shapes. Furthermore, the inlet guide vane assembly can improve exhauster efficiency and therefore pulverizer efficiency for other forms of pulverizers in addition to bowl mills.

The inlet guide vane assembly in accordance with the invention defines multiple inlet guide vanes having a generally cross-hatch pattern in cross-section at the final elbow of the ductwork leading to the inlet of the exhauster. The inlet guide vanes extend longitudinally in the direction of the air flow to the inlet of the exhauster and across the width of the duct. The guide vanes are further preferably planar and have an orthogonal arrangement. In one embodiment of the invention, the inlet guide vanes together define a slightly rotated or helical shape to result in a counter rotation of the air stream relative to the direction of fan rotation of the exhauster.

An object of the invention is to provide an inlet vane guide assembly that improve the efficiency of air flow through an exhauster.

Another object of the invention is to provide an inlet guide vane assembly that improves pulverizer efficiency.

These and other objects of the invention will become apparent from review of the specification and drawings.

DESCRIPTION OF THE PREFERRED EMBODIMENT

Figure 1:
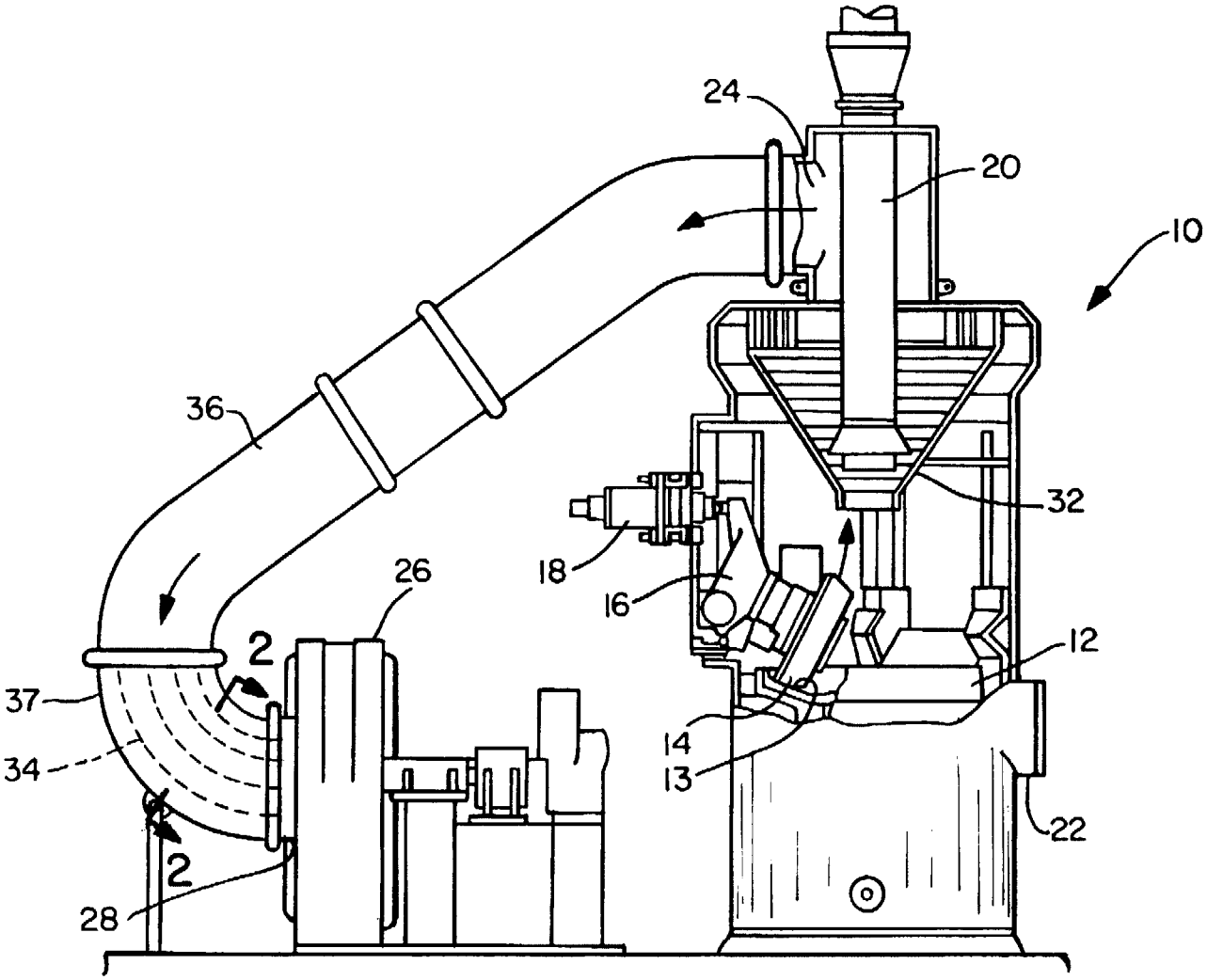
FIG. 1 is an elevated side view, partially broken away, and partially in phantom, of a bowl mill, an exhauster apparatus employing an inlet guide vane assembly in accordance with the invention.

A bowl mill 10 has a rotating grinding table or bowl 12 oriented to define a generally vertical axis of rotation. (See FIG. 1) The bowl 12 supports an angled replaceable grinding surface 13 on the interior of the bowl. A roller journal 16 rotatably supports a roller 14 over the grinding surface 13 of the bowl 12. A pressure mechanism 18, such as a spring or hydraulic cylinder biases the roller 14 toward the grinding surface 13 of the bowl 12. Positioned above the bowl 12 is a solid fuel supply tube 20 for supplying a solid fuel to the central portion of the bowl 12.

Figure 4:
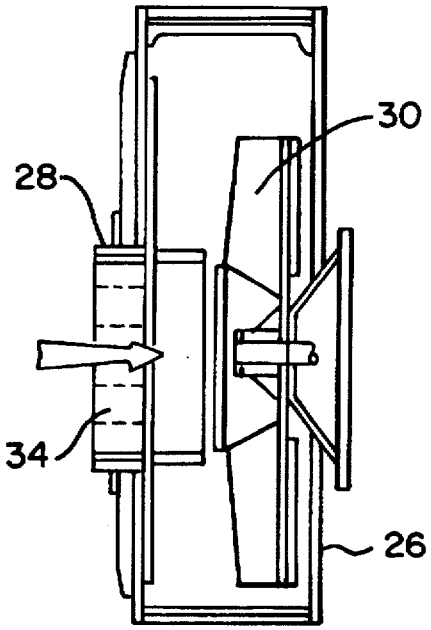
FIG. 4 is a partially broken away view of an exhauster.

The bowl mill 10 defines an air inlet 22 for the entry of primary air beneath the bowl 12. The bowl mill 10 further defines an air stream outlet 24 positioned above the bowl 12. An exhauster 26, positioned in a suction arrangement, draws primary air through the bowl mill 10. A duct 36 defines an air flow path (see arrows of FIG. 1) between the outlet 24 of the bowl mill 10 and an inlet 28 of the exhauster 26. The exhauster 26 employs a rotating fan 30 for drawing the primary air through the bowl mill 10. (See FIG. 4) The incoming primary air is preferably heated by use of a preheater (not shown) transferring heat from the outgoing flue gas of the furnace to the incoming combustion air. The primary air is then drawn through the air inlet 22 below the bowl 12 and upward around the outside of the bowl 12. Pulverized solid fuel becomes entrained in the primary air to form an air stream.

The air stream is drawn further upward through a classifier 32 for the classification of the entrained solid fuel. The air stream is withdrawn from the top of the bowl mill 10 through the air stream outlet 24. The duct 36 directs the air stream from the air stream outlet 24 to the inlet 28 of the exhauster 26.

Figure 2:
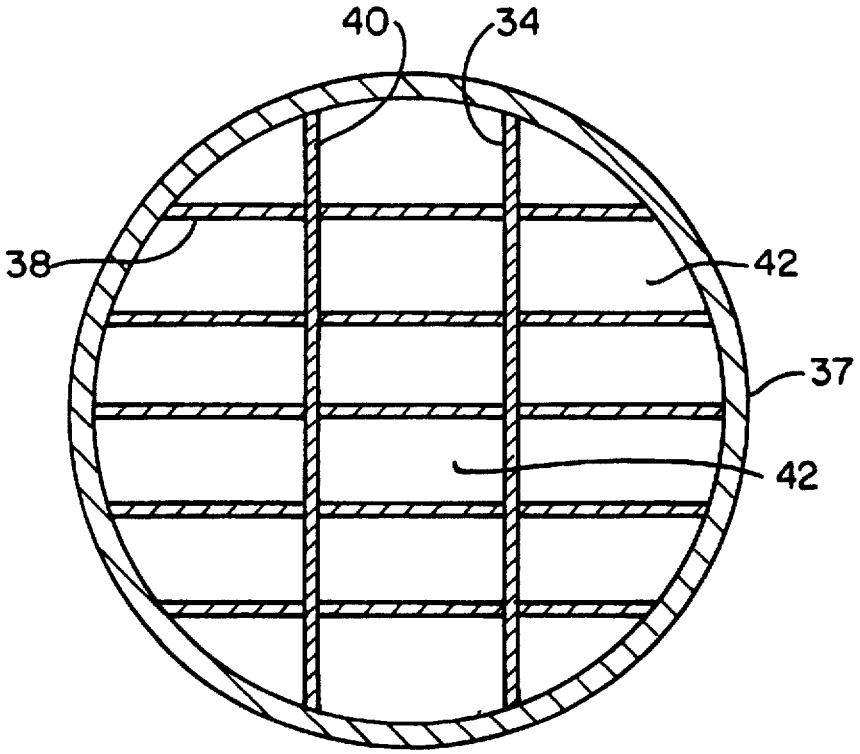
FIG. 2 is a cross-sectional view, taken along the line 2—2 of the duct and inlet guide vane assembly of FIG. 1.

A preferred embodiment of an inlet guide vane assembly 34 in accordance with the invention is positioned in a curved exhauster portion 37 of the duct 36 adjacent the inlet 28 of the exhauster 26. The inlet guide vane assembly 34 has a plurality of mutually parallel planar first guide vanes 38. (See FIG. 2) The first guide vanes 38 extend longitudinally in the direction of the flow of the air stream toward the inlet 28 of the exhauster 26, and transversely across substantially the entire width of the exhauster portion 36 of the duct 28. A plurality of mutually parallel planar second guide vanes 40 are oriented preferably orthogonally to the first guide vanes 38. The second guide vanes 40 also extend longitudinally in the direction of the flow of the air stream toward the inlet 28 of the exhauster 26, and transversely across substantially the entire width of the exhauster portion 37 of the duct 36.

The first and second guide vanes 38, 40 together define multiple flow channels 42 therebetween for the controlled flow of the air stream through the exhauster portion 37 of the duct 36. The flow channels 42, defined by the first and second inlet guide vanes 38, 40, are generally parallel to each other and further parallel with the air flow path defined by the exhauster portion 37 of the duct 36. The inlet guide vane assembly 34 preferably has a minimal total cross-section in order to minimize blockage to the flow of the air stream and further reduce wear of the inlet guide vane assembly due to wear with the pulverized solid fuel.

During operation of a conventional exhauster, the fan 30 induces a swirl in the air stream that reduces the flow rate, and therefore the efficiency of the exhauster 26. The inlet guide vane assembly 34 improves the flow of the air and pulverized fuel by reducing the degree of swirl induced on the air stream as a result of the fan rotation of the exhauster 26. This reduction in the swirl of the air stream results in improved flow efficiency of the exhauster 26, and therefore, increased efficiency of the bowl mill 10.

The inlet guide vane assembly 34 is preferably positioned in the curved exhauster portion 37 of the duct 36 adjacent the exhauster inlet 28. However, it should be recognized that the inlet guide vane assembly 34 can extend inward through the inlet 28 toward the fan 30. Furthermore, the inlet guide vane assembly 34 is readily adaptable for mounting in the straight exhauster inlet portions of ducts employed with exhausters and pulverizers having alternate orientations or positioning.

Figure 3:
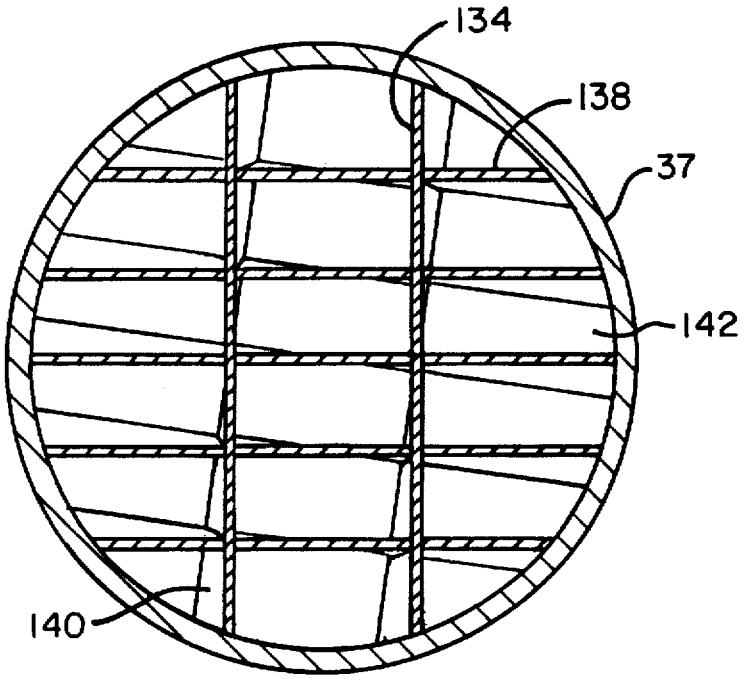
FIG. 3 is a sectional view of a duct and an alternate inlet guide vane assembly in accordance with the invention.

In an alternate embodiment in accordance with the invention, a inlet guide vane assembly 134 induces rotation of the air stream counter to the direction of the rotation of the fan 30 of the exhauster 26. (See FIG. 3) The inlet guide vane assembly 134 has pluralities of generally parallel in cross-section first guide vanes 138 extending longitudinally in the direction of the flow of the air stream toward the inlet 28 of the exhauster 26, and transversely across substantially the entire width of the exhauster portion 37 of the duct 36. The first guide vanes 138, for at least a portion of the exhauster portion 37 of the duct 36, define a rotated or helical shape to induce a counter rotation in the air stream relative to the rotation of the fan 30. The inlet guide vane assembly 134 further has second guide vanes 140 oriented generally orthogonally to the first guide vanes 138 in cross-section. The second guide vanes 138 also extend longitudinally in the direction of the flow of the air stream toward the inlet 28 of the exhauster 26 and transversely across substantially the entire width of the exhauster portion 37 of the duct 36. The second guide vanes 138 also further define, for at least a portion of the exhauster portion 37, a rotated or helical shape to induce counter rotation in the air stream relative to the direction of rotation of the fan 30 of the exhauster 26. Therefore, the first and second inlet guide vanes 138, 140 are rotated in the same direction counter to the direction of rotation of the fan 30.

The first and second guide vanes 138, 140 define pluralities of curved flow channels 142. The flow channels 142, as a result of the shape of the first and second guide vanes 138, 140, are helical or corkscrew in shape. The flow channels 142 therefore form a total general flow path of the air stream that has a rotation opposite that of the rotation of the fan 30 of the exhauster 26. For simplified construction, the first and second guide vanes 138, 140 can be generally straight segments angled relative to the flow stream to direct the air stream in a direction of rotation counter to the rotation of the fan 30.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

We claim:

1. Apparatus for providing a supply of pulverized solid fuel comprising:

an exhauster assembly having an exhauster housing defining an inlet opening and a fan rotatably mounted in said exhauster housing, said fan providing an air stream;

a duct for defining an air stream flow path, said duct having first and second end portions, said first end portion being in fluid connection with said inlet opening;

a pulverizer for supplying the pulverized solid fuel, said pulverizer being in fluid communication with said second end portion of said duct, whereby the pulverized solid fuel is entrained in said air stream; and an inlet guide vane assembly disposed in said first end portion of said duct, said inlet guide vane assembly having a plurality of vanes defining a plurality of flow channels generally parallel to said air stream flow path for guiding said air stream and said entrained pulverized solid fuel into said exhauster assembly.

2. Apparatus of claim 1 wherein said vanes are planar and mutually parallel.

3. Apparatus of claim 2 wherein said duct defines a width and said vanes extend across the entire said width of said duct.

4. Apparatus of claim 1 wherein said inlet guide vane assembly comprises first guide vanes and second guide vanes generally orthogonal to said first guide vanes.

5. Apparatus of claim 4 wherein said first and second guide vanes are planar.

6. Apparatus of claim 5 wherein said duct defines a width and said first and second guide vanes extend entirely across said width of said duct.

7. Apparatus of claim 5 wherein said first guide vanes are mutually parallel and said second guide vanes are mutually parallel.

8. Apparatus of claim 1 wherein said flow channels have a helical shape.

9. Apparatus of claim 1 wherein said guide vanes define a cross hatch pattern in cross section.

10. Apparatus of claim 1 wherein said fan defines a direction of rotation and said vanes are helical defining a rotation opposite said direction of rotation of said fan.

11. Apparatus of claim 1 wherein said first end portion of said duct has a longitudinal length and said vanes extend longitudinally said length of said first end portion.

* * * * *